US010969211B2

(12) United States Patent
Blache et al.

(10) Patent No.: US 10,969,211 B2
(45) Date of Patent: Apr. 6, 2021

(54) SABOT WITH BIONIC STRUCTURES

(71) Applicant: RHEINMETALL WAFFE MUNITION GMBH, Unterluess (DE)

(72) Inventors: Andreas Blache, Loerrach (DE); Lutz Boerngen, Uelzen (DE); Michael Gowin, Hermannsburg (DE); Katrin Linke, Braunschweig (DE)

(73) Assignee: Rheinmetall Waffe Munition GmbH, Unterluess (DE)

( * ) Notice: Subject to any disclaimer, the term of this patent is extended or adjusted under 35 U.S.C. 154(b) by 153 days.

(21) Appl. No.: 16/245,955

(22) Filed: Jan. 11, 2019

(65) Prior Publication Data

US 2020/0025541 A1 Jan. 23, 2020

Related U.S. Application Data

(63) Continuation of application No. PCT/EP2017/064074, filed on Jun. 9, 2017.

(30) Foreign Application Priority Data

Jul. 11, 2016 (DE) ..... 10 2016 112 666.7

(51) Int. Cl.
*F42B 14/06* (2006.01)

(52) U.S. Cl.
CPC ..... *F42B 14/068* (2013.01); *F42B 14/061* (2013.01)

(58) Field of Classification Search
CPC ..... F42B 14/068; F42B 14/061
USPC ..... 102/521
See application file for complete search history.

(56) References Cited

U.S. PATENT DOCUMENTS

| | | | | |
|---|---|---|---|---|
| 3,430,572 | A * | 3/1969 | Hebert | F42B 14/08 102/521 |
| 4,651,649 | A | 3/1987 | Nussbaum | |
| 5,404,816 | A | 4/1995 | Burri | |
| 6,609,043 | B1 | 8/2003 | Zoia et al. | |
| 7,261,042 | B1 | 8/2007 | Brooks | |
| 8,813,651 | B1 | 8/2014 | Hooke | |
| 9,851,186 | B2 * | 12/2017 | Brown | F42B 10/26 |
| 10,132,578 | B2 | 11/2018 | Knowlen et al. | |
| 10,591,263 | B2 * | 3/2020 | Brown | F42B 10/24 |
| 2012/0000390 | A1 | 1/2012 | Heitmann | |
| 2014/0326158 | A1 | 11/2014 | Fritz | |
| 2015/0192394 | A1 | 7/2015 | Fritz | |

(Continued)

FOREIGN PATENT DOCUMENTS

| | | | |
|---|---|---|---|
| DE | 2924041 | A1 | 12/1980 |
| DE | 3034471 | A1 | 4/1982 |
| DE | 3332023 | A1 | 3/1985 |

(Continued)

OTHER PUBLICATIONS

International Search Report dated Sep. 1, 2017 in corresponding application PCT/EP2017/064074.

*Primary Examiner* — Samir Abdosh
(74) *Attorney, Agent, or Firm* — Muncy, Geissler, Olds & Lowe, P.C.

(57) ABSTRACT

A sabot in which bionic structures are provided. The structures are generated or created by way of an additive manufacturing process during the manufacture of the sabot in a defined manner with respect to size, shape and/or volume and in a targeted manner with respect to the local and quantitative embedding in the sabot.

13 Claims, 1 Drawing Sheet

(56) References Cited

U.S. PATENT DOCUMENTS

| | | | | |
|---|---|---|---|---|
| 2018/0154446 | A1* | 6/2018 | Brown | F42B 10/24 |
| 2018/0356194 | A1* | 12/2018 | Kezerian | F42B 14/062 |

FOREIGN PATENT DOCUMENTS

| | | | |
|---|---|---|---|
| DE | 4034062 | A1 | 4/1992 |
| DE | 19625273 | A1 | 1/1998 |
| DE | 102009049440 | A1 | 7/2011 |
| DE | 102012022894 | A1 | 5/2014 |
| EP | 0047820 | A2 | 3/1982 |
| FR | 2506925 | A | 12/1982 |
| JP | H07159098 | A | 6/1995 |
| JP | 3882726 | B2 | 2/2007 |
| WO | WO2016057707 | A2 | 4/2016 |

* cited by examiner

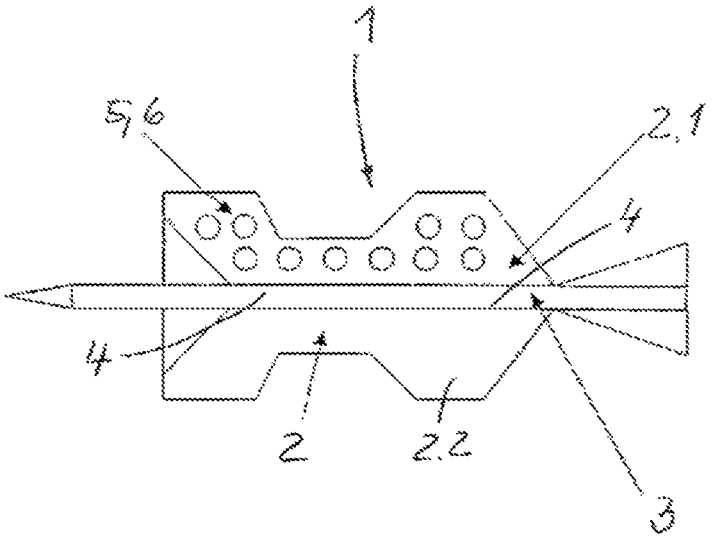
1
5,6
2,1
4
4
2
2,2
3

SABOT WITH BIONIC STRUCTURES

This nonprovisional application is a continuation of International Application No. PCT/EP2017/064074, which was filed on Jun. 9, 2017, and which claims priority to German Patent Application No. 102016112666.7, which was filed in Germany on Jul. 11, 2016, and which are both herein incorporated by reference.

BACKGROUND OF THE INVENTION

Field of the Invention

The present invention relates to the production of a sabot of a sub-caliber kinetic-energy projectile in a small-caliber, medium-caliber and large caliber ranges. The invention considers ideas about obtaining a bionic sabot of reduced weight by for example providing globular cavities in the sabot.

Description of the Background Art

To achieve high penetrating powers, so-called KE (kinetic-energy) munitions are used. The munitions generally consist of a metallic penetrator (kinetic-energy projectile), preferably of heavy metal of a high strength and toughness. The penetrators are of a form similar to a nail or arrow. They are smaller in caliber (sub-caliber) than the barrel of the weapon from which they are fired. To be able to be fired from the barrel of a weapon, a sabot is required, enclosing the penetrator and maintaining the caliber with respect to the barrel. The sabot assumes the task of sealing the barrel of the weapon from powder gases during firing. By means of the gas pressure that is created by the burning off of the powder, a force is applied over projected surface areas of the sabot, with the joint effect of accelerating the sabot.

The task of the sabot is to carry the penetrator along as it passes through the barrel, to apply the acceleration, to provide a seal with respect to the barrel of the weapon, to guide the penetrator and to release the penetrator without any disturbance after it leaves the muzzle of the barrel.

Depending on the caliber, the sabots are produced from plastic, metals or a combination of the two. The heavier the sabot is, the lower the acceleration, and consequently the lower the achievable muzzle velocity. Therefore, the lighter the sabot, the higher the muzzle velocity becomes, and the higher the achievable range of engagement. With the same range of engagement, a higher depth of penetration/penetrating power of the penetrator can be achieved.

In practice, for battle tank ammunition, high-strength aluminum or packed plastic is used as the material for the sabots. Further weight savings are made by introducing bores, slits, etc.

DE 196 25 273 A1 discloses a sub-caliber kinetic-energy projectile, the sabot of which consists of a fiber-reinforced material. The bottom of the sabot is provided with openings. The fiber-reinforced material is a carbon-fiber-reinforced plastic or a carbon-fiber-reinforced carbon. Other reinforcing fibers for plastics may be aramid fibers or polyethylene fibers. Reinforcing fibers for metals, such as aluminum, magnesium or titanium, include $Al_2O_3$ fibers or SiC fibers.

A sabot for a sub-caliber sabot projectile is disclosed by DE 29 24 041 C2. The material of the sabot is a ceramic or glass, with a prestress. Prestressed glass or other ceramic materials with corresponding behavior have a very high mechanical strength. The disintegration of the sabot is initiated by a mass, which is propelled against the inner wall of the sabot. The mass itself is held in a cavity.

A sub-caliber kinetic energy projectile with a projectile guide that can be broken up is described by DE 30 34 471 A1. To achieve a low dead weight while retaining the compressive and tensile strength, the projectile guide is produced as a pressed part from hollow glass beads with polymer binding material or glass binding material. Alternatively, foam glass or syntactic foams are mentioned.

A sabot according to DE 10 2009 049 440 A1 is distinguished by being completely or at least partially made up of a material foam. The material foam may be a metal foam such as aluminum foam, zinc foam, Foaminal, etc., wherein the material foam can be used as a sandwich component having layers of the same or a different material, a reinforced fiber material and/or a core of a different material.

In the case of plastics/fiber composites, aging, chemical compatibility with the powders, susceptibility to UV radiation, etc. combined with high costs of production may be mentioned as disadvantages. The required insensitivity during handling of the munition (dropping, vibration while being transported in the ammunition containers) is problematic.

SUMMARY OF THE INVENTION

The object of the invention is that the obtainment of parts of a sabot of reduced weight with respect to systems introduced and of sufficient environmental resistance that can be produced at low cost, while retaining a maximum muzzle velocity, can be ensured.

The invention is based on the idea of producing the sabot or the parts of the sabot with reduced weight by means of bionic structures, the structures ensuring sufficient stability, etc. of the sabot or the parts of the sabot. In this case, these structures are only created during the production process. In other words, the bionic structures (for example honeycombs, struts, voids, spherical cavities and combinations thereof) are created by the production process in that they are left out during production.

Such processes may be for example the 3D printing process, for example from plastics, or laser sintering processes. By means of plastic laser sintering, the sabot or the sabot parts or segments are produced with bionic structures of plastic. Metal laser sintering makes it possible to produce the sabot or sabot parts or segments with the bionic structures from a metal, such as for example aluminum. The range here is from lightweight metal through to superalloys. Likewise not excluded from these considerations is production by means of 3D cocooners, even though this process appears to be more elaborate. It involves creating the bionic structures from a handling spinneret. At present, for this, glass fibers are adhesively bonded and simultaneously laminated with UV-curing resin to form complex structures.

The bionic structures give the sabot or the sabot segments the necessary strength and stiffness for passing through the barrel along with a maximum weight reduction.

The advantage of such processes lies in the definable configurations of the cavities, etc. The size and shape (volume) of the cavities can be influenced directly (programming in 3D). A direct influence is also possible on the number or amount and distribution within the sabot or the sabot segments (sabot parts).

Proposed is a sabot in which bionic structures are provided, generated or created by a 3D production process in a defined manner in terms of size, shape and/or volume and in a specifically directed manner within the sabot during the production of the sabot. Specifically directed in this case are the local embedding within the sabot and the number of bionic structures, i.e. the local and quantitative embedding within the sabot.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawing which is given by way of illustration only, and thus, are not limitive of the present invention, and wherein the sole FIGURE illustrates a munition with a sabot.

DETAILED DESCRIPTION

The invention is to be explained in more detail with the drawing on the basis of an exemplary embodiment. The single FIGURE diagrammatically shows a munition 1 with a sabot 2 and a penetrator 3. The sabot 2 encloses the penetrator 2 and can be connected to the penetrator 2 at least in the form-fitting region 4. The form-fitting region 4 may comprise a thread (not represented any more specifically). The sabot 2 may consist of a number of segments 2.1, 2.2, which are held together by way of a sealing and/or guiding band (not represented any more specifically).

To reduce weight, the segmented sabots 2.1, 2.2 have bionic structures 5. Shapes such as honeycombs, struts, voids, cavities and combinations thereof are defined as bionic structures 5. The cavities 6 may in this case be spherical, angular, etc.

The sabot 2 or the sabot segments 2.1, 2.2 may be produced by 3D printing or the SLS process (laser sintering). The geometrical data of the sabot segments 2.1, 2.2 are in a three-dimensional form for this and are stored as layer data.

In the case of metal laser sintering, furthermore, a casting pattern (not represented any more specifically) is produced from the geometrical molds. Then the available CAD data of the sabot segments 2.1, 2.2 (for example STL format) are used to build up the sabot segments 2.1, 2.2 layer by layer in a layered buildup. Regions are left out in the layers, so that the bionic structures 5, for example globular cavities 6, can be introduced/integrated into the sabot segments 2.1, 2.2 in a defined manner in terms of shape, size and volume.

In the case of 3D printing, a layered buildup of the sabot segments 2.1, 2.2 takes place in layers without a casting mold. For this purpose, the sabot segments 2.1, 2.2 with their bionic structures 5, 6 are available in three-dimensional data and are built up layer by layer.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A sabot for a sub-caliber projectile, the sabot comprising bionic structures formed by a 3D production process in a defined manner and in a specifically directed manner during the production of the sabot, wherein the bionic structures are fully embedded and enclosed by material of the sabot.

2. The sabot as claimed in claim 1, wherein the bionic structures are honeycombs, struts, voids, spherical cavities and combinations thereof.

3. The sabot as claimed in claim 1, wherein the sabot has at least two sabot segments.

4. The sabot as claimed in claim 1, wherein the size, shape and/or volume of the bionic structures are predeterminable.

5. The sabot as claimed in claim 1, wherein the number of bionic structures is predeterminable.

6. The sabot as claimed in claim 1, wherein the material of the sabot is a lightweight metal, a metal and/or plastic.

7. A process for producing a sabot as claimed in claim 1, wherein the 3D production process is a 3D printing process.

8. A process for producing a sabot as claimed in claim 1, wherein the 3D production process is an SLS.

9. A munition comprising:

a sabot as claimed in claim 1; and a sub-caliber projectile.

10. A munition comprising:

a sabot produced as claimed in claim 7; and a sub-caliber projectile.

11. A process for producing a sabot as claimed in claim 1, wherein the 3D production process is carried out by a 3D cocooner, wherein the bionic structures are created by a handling spinneret.

12. A process for producing a sabot comprising bionic structures for a sub-caliber projectile, the process comprising:

forming, by a 3D production process, bionic structures in a defined manner, such that during the production of the sabot, regions of material of the sabot are left out or omitted to form the bionic structures.

13. The process according to claim 12, wherein the bionic structures are fully embedded and enclosed by the material of the sabot.

* * * * *